US009809761B2

(12) United States Patent
Hoehn et al.

(10) Patent No.: US 9,809,761 B2
(45) Date of Patent: Nov. 7, 2017

(54) HYDROCARBON PROCESSING APPARATUSES AND METHODS OF REFINING HYDROCARBONS WITH ABSORPTIVE RECOVERY OF C3+ HYDROCARBONS

(71) Applicant: UOP LLC, Des Plaines, IL (US)

(72) Inventors: Richard Hoehn, Mt. Prospect, IL (US); Juan Carlos Vargas, Kingston (GB); Dharmesh Chunilal Panchal, Surbiton (GB)

(73) Assignee: UOP LLC, Des Plaines, IL (US)

( * ) Notice: Subject to any disclaimer, the term of this patent is extended or adjusted under 35 U.S.C. 154(b) by 265 days.

(21) Appl. No.: 14/538,584

(22) Filed: Nov. 11, 2014

(65) Prior Publication Data

US 2016/0130512 A1 May 12, 2016

(51) Int. Cl.
*C10G 53/00* (2006.01)
*C10G 53/08* (2006.01)
(Continued)

(52) U.S. Cl.
CPC ..... *C10G 53/08* (2013.01); *C10G 55/06* (2013.01); *C10G 70/06* (2013.01); *C10G 2300/202* (2013.01)

(58) Field of Classification Search
CPC ..... C10G 53/08; C10G 70/06; C10G 55/06; C10G 2300/202
See application file for complete search history.

(56) References Cited

U.S. PATENT DOCUMENTS 6,308,532 B1 10/2001 Hopewell
6,504,038 B1 1/2003 Van Der Sluis
(Continued)

OTHER PUBLICATIONS

Zaheer et al., How to Treat Refinery Gases and Make them Suitable to Recover Valuable Liquids, GPA Annual Convention Proceedings, v 1, p. 350-376, 2009, 88th Annual Convention of the Gas Processors Association 2009—2009 GPA Convention—Enhancing Midstream's Voice; ISSN: 0968870; ISBN-13: 9781615676729.
(Continued)

*Primary Examiner* — Randy Boyer
*Assistant Examiner* — Juan Valencia

(57) ABSTRACT

Hydrocarbon processing apparatuses and methods of refining hydrocarbons are provided herein. In an embodiment, a method of refining hydrocarbons includes providing a cracked stream that includes a sulfur-containing component and cracked hydrocarbons. The cracked stream is compressed to produce a pressurized cracked stream. The pressurized cracked stream is separated to produce a pressurized vapor stream and a liquid hydrocarbon stream. The pressurized vapor stream includes C4− hydrocarbons and the liquid hydrocarbon stream includes C3+ hydrocarbons. The liquid hydrocarbon stream is separated to produce a first liquid absorption stream that includes C5+ hydrocarbons and a C4− hydrocarbon stream. C3+ hydrocarbons are absorbed from the pressurized vapor stream through liquid-vapor phase absorption using the first liquid absorption stream. The sulfur-containing component is removed prior to absorbing C3+ hydrocarbons from the pressurized vapor stream.

20 Claims, 2 Drawing Sheets

(51) Int. Cl.
*C10G 55/06* (2006.01)
*C10G 70/06* (2006.01)

(56) References Cited

U.S. PATENT DOCUMENTS

| | | | | |
|---|---|---|---|---|
| 6,576,805 | B2 | 6/2003 | Keady et al. | |
| 7,041,271 | B2 | 5/2006 | Drnevich et al. | |
| 8,007,661 | B1 | 8/2011 | Schultz et al. | |
| 8,066,868 | B1 | 11/2011 | Zimmermann | |
| 8,128,895 | B2 | 3/2012 | Schultz | |
| 2010/0293854 | A1* | 11/2010 | Mak | B01D 53/1468 48/127.9 |
| 2011/0110829 | A1* | 5/2011 | da Silva Ferreira Alves | C10G 7/00 422/610 |
| 2012/0053383 | A1 | 3/2012 | Malaty et al. | |
| 2012/0172649 | A1* | 7/2012 | Yadav | C10G 11/18 585/809 |

OTHER PUBLICATIONS

Drnevich et al., Cost Effective Technology for Organic Sulfur Removal from Refinery Fuel Gas, National Petroleum Refiners Association Annual Meeting Technical Papers, p. 667-677, 2011, NPRA Annual Meeting 2011, ISBN-13; 9781617829222; Mar. 20-22, 2011.

Wolschlag et al., UOP FCC Design Advancements to Reduce Energy Consumption and CO2 Emmissions, National Petroleum Refiners Association Annual Meeting Technical Papers, v 1, p. 299-330, NPRA Annual Meeting 2009; ISBN-13; 9781615671632, Mar. 22-24, 2009.

* cited by examiner

HYDROCARBON PROCESSING APPARATUSES AND METHODS OF REFINING HYDROCARBONS WITH ABSORPTIVE RECOVERY OF C3+ HYDROCARBONS

TECHNICAL FIELD

The technical field generally relates to hydrocarbon processing apparatuses and methods of refining hydrocarbons, and more particularly relates to hydrocarbon processing apparatuses and methods of refining hydrocarbons with absorptive recovery of C3+ hydrocarbons from a high pressure vapor stream.

BACKGROUND

Fluid catalytic cracking (FCC) is a well-known process for the conversion of relatively high boiling point hydrocarbons to lighter boiling hydrocarbons in the heating oil or gasoline (or lighter) range. Such processes are commonly referred to in the art as "upgrading" processes, and "FCC" as referred to herein encompasses conventional FCC processes and residual FCC processes. To conduct FCC processes, FCC units are generally provided with one or more reaction chambers. A hydrocarbon stream is typically contacted in the one or more reaction chambers with a particulate cracking catalyst that is maintained in a fluidized state under conditions that are suitable for the conversion of relatively high boiling point hydrocarbons to lighter boiling hydrocarbons.

Typically, the lighter boiling hydrocarbons are withdrawn from the FCC unit as an offgas stream, which is separated into various intermediate and product hydrocarbon streams in an FCC main column. A fraction that remains in vapor form from the FCC main column is taken as a main column overhead stream and fed to an overhead receiver, where liquid fractions and a residual vapor stream are separated. The residual vapor stream is compressed to form a pressurized stream in preparation for further separation of components therefrom. In particular, the pressurized stream is generally fed to a high pressure receiver, which separates the pressurized stream into one or more liquid streams and a high pressure vapor stream. It is generally desirable to separate C3+ hydrocarbons from the high pressure vapor stream, and such separation is often conducted through liquid-vapor phase absorption in a primary absorber. As referred to herein, "CX" means hydrocarbon molecules that have "X" number of carbon atoms, CX+ means hydrocarbon molecules that have "X" and/or more than "X" number of carbon atoms, and CX− means hydrocarbon molecules that have "X" and/or fewer than "X" number of carbon atoms.

To separate C3+ hydrocarbons from the high pressure vapor stream, a stabilized and/or unstabilized gasoline stream is often employed as a liquid absorption stream in the primary absorber. The stabilized gasoline stream is generally derived from the high pressure vapor stream and may be provided from a debutanizer column after separation of C4− hydrocarbons. The unstabilized gasoline stream contains C4+ hydrocarbons and is generally derived from the main column overhead stream as a liquid stream provided from the overhead receiver. A high flow rate of the stabilized and/or unstabilized gasoline streams is often required to effectively separate the C3+ hydrocarbons in the primary absorber, which impacts capital and operating expenses associated with separation of C3+ hydrocarbons from the high pressure vapor stream.

Accordingly, it is desirable to provide hydrocarbon processing apparatuses and methods of refining hydrocarbons with minimized flow rate of stabilized and/or unstabilized gasoline streams during absorptive separation of C3+ hydrocarbons from the high pressure vapor stream. Furthermore, other desirable features and characteristics will become apparent from the subsequent detailed description and the appended claims, taken in conjunction with the accompanying drawings and this background.

BRIEF SUMMARY

Hydrocarbon processing apparatuses and methods of refining hydrocarbons are provided herein. In an embodiment, a method of refining hydrocarbons includes providing a cracked stream that includes a sulfur-containing component and cracked hydrocarbons. The cracked stream is compressed to produce a pressurized cracked stream. The pressurized cracked stream is separated to produce a pressurized vapor stream and a liquid hydrocarbon stream. The pressurized vapor stream includes C4− hydrocarbons and the liquid hydrocarbon stream includes C3+ hydrocarbons. The liquid hydrocarbon stream is separated to produce a first liquid absorption stream that includes C5+ hydrocarbons and a C4− hydrocarbon stream. C3+ hydrocarbons are absorbed from the pressurized vapor stream through liquid-vapor phase absorption using the first liquid absorption stream. The sulfur-containing component is removed prior to absorbing C3+ hydrocarbons from the pressurized vapor stream.

In another embodiment, a method of refining hydrocarbons includes cracking a hydrocarbon stream that includes a sulfur-containing component in a fluid catalytic cracking stage to produce a cracked stream that includes the sulfur-containing component and cracked hydrocarbons. The cracked stream is compressed to produce a pressurized cracked stream. The pressurized cracked stream is separated in a pressurized separation stage to produce a pressurized vapor stream and a liquid hydrocarbon stream. The pressurized vapor stream includes C4− hydrocarbons and the liquid hydrocarbon stream includes C3+ hydrocarbons and the sulfur-containing component. The liquid hydrocarbon stream is fractionated to produce an intermediate C3+ stream and a recovered C3− vapor stream. The C3+ stream includes C3+ hydrocarbons and the recovered C3− vapor stream includes C3− hydrocarbons and the sulfur-containing component. The sulfur-containing component is removed from the recovered C3− vapor stream to produce a purified C3− vapor stream. The purified C3− vapor stream is recycled to the pressurized separation stage. C3+ hydrocarbons from the pressurized vapor stream are absorbed through liquid-vapor phase absorption using a liquid absorption stream.

In another embodiment, a hydrocarbon processing apparatus includes a fluid catalytic cracking unit that has the capacity to catalytically crack a hydrocarbon stream that includes a sulfur-containing component, and the fluid catalytic cracking unit further has the capacity to produce an offgas stream that includes the sulfur-containing component and cracked hydrocarbons. A compressor is in fluid communication with the fluid catalytic cracking unit and has the capacity to produce a pressurized cracked stream. A high pressure receiver is in fluid communication with the compressor and has the capacity to separate the pressurized cracked stream into a pressurized vapor stream and a liquid hydrocarbon stream. A debutanizer column is in fluid communication with the high pressure receiver and has the capacity to produce a first liquid absorption stream. A liquid-vapor phase separator is in fluid communication with the debutanizer column. The liquid-vapor phase separator is configured to contact the pressurized vapor stream and the first liquid absorption stream therein. A contaminant removal unit is disposed upstream of the liquid-vapor phase separator and downstream of the fluid catalytic cracking unit. The contaminant removal unit is configured to remove the sulfur-containing component.

BRIEF DESCRIPTION OF THE DRAWINGS

The various embodiments will hereinafter be described in conjunction with the following drawing figures, wherein like numerals denote like elements, and wherein.

DETAILED DESCRIPTION

The following detailed description is merely exemplary in nature and is not intended to limit the hydrocarbon processing apparatuses or methods of refining hydrocarbons. Furthermore, there is no intention to be bound by any theory presented in the preceding background or the following detailed description.

Hydrocarbon processing apparatuses and methods of refining hydrocarbons are provided herein that enable efficient recovery of C3+ hydrocarbons from a high pressure vapor stream obtained from fluid catalytic cracking. In particular, without being bound by theory, it is believed that the presence of a sulfur-containing component in the high pressure vapor stream inhibits C3+ absorption using a stabilized and/or unstabilized gasoline stream and, thus, necessitates higher flow rates of the stabilized and/or unstabilized gasoline streams during absorptive separation of C3+ hydrocarbons from the high pressure vapor stream than may otherwise be required to effectively separate the C3+ hydrocarbons. Many hydrocarbon feedstocks that are subject to FCC processing include sulfur-containing species, and the sulfur-containing species remain in the resulting cracked stream that is produced by FCC processing. As referred to herein, the "sulfur-containing component" includes all sulfur-containing species that may be present in the cracked stream that is produced during FCC processing. An example of a common sulfur-containing species that may be included in the cracked stream is hydrogen sulfide. In accordance with the methods and apparatuses described herein, the sulfur-containing component is removed prior to absorbing C3+ hydrocarbons from the pressurized vapor stream, thereby maximizing C3+ recovery efficiency during absorptive separation of the C3+ hydrocarbons from the high pressure vapor stream. By "prior to" or "upstream" as referred to herein, it is meant that the sulfur-containing component may be removed from the high pressure vapor stream or from any stream that contains components that are eventually included in the high pressure vapor stream. For example, the sulfur-containing component may be removed from the high pressure vapor stream or from a recovered C3− vapor stream that is recycled and that includes C3 hydrocarbons that are eventually included in the high pressure vapor stream. Additionally, it is to be appreciated that removal of the sulfur-containing component refers to partial or complete removal of the sulfur-containing component from the referenced stream.

Figure 1:
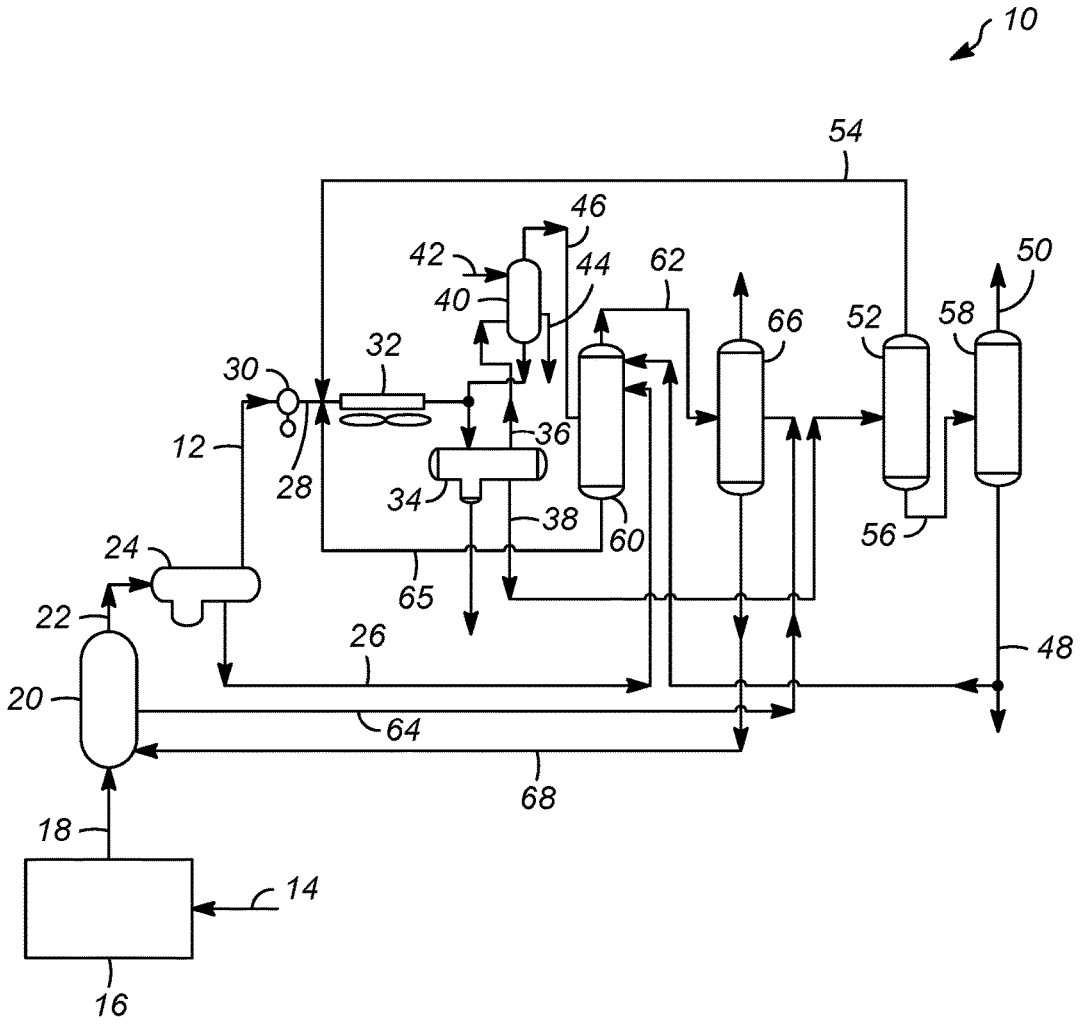
FIG. 1 is a schematic diagram of a hydrocarbon processing apparatus and method of refining hydrocarbons in accordance with an exemplary embodiment.

An embodiment of a method of refining hydrocarbons will now be described with reference to an exemplary hydrocarbon processing apparatus 10 as shown in FIG. 1. In accordance with the exemplary method, a cracked stream 12 is provided that includes a sulfur-containing component and cracked hydrocarbons. Cracked hydrocarbons include any hydrocarbons that are produced by a cracking process. In embodiments, the cracked stream 12 is provided by cracking a hydrocarbon stream 14 that includes the sulfur-containing component in a fluid catalytic cracking (FCC) stage to produce the cracked stream 12 that includes the sulfur-containing component and cracked hydrocarbons. The hydrocarbon stream 14 is not particularly limited and may be derived from renewable and/or fossil sources, provided that the hydrocarbon stream 14 includes the sulfur-containing component. The exemplary FCC stage includes one or more FCC units 16 that have the capacity to catalytically crack the hydrocarbon stream 14 and to produce an offgas stream 18 that includes the sulfur-containing component and cracked hydrocarbons. The offgas stream 18 is fed to a FCC main column 20, which is in fluid communication with the FCC unit 16. The FCC main column 20 has the capacity to fractionate the offgas stream 18 and produce an overhead vapor stream 22 in accordance with conventional techniques. In particular, during fractionation, the offgas stream 18 is separated into various product and/or intermediate hydrocarbon streams including the overhead vapor stream 22 that includes all uncondensed species from the offgas stream 18 that remain after passing through the FCC main column 20. The overhead vapor stream 22 is fed to a main column vapor receiver 24 that is in fluid communication with the FCC main column 20 and that has the capacity to separate the overhead vapor stream 22 into one or more liquid streams and a fractionation vapor stream. As shown, the fractionation vapor stream from the main column vapor receiver 24 is provided as the cracked stream 12 that is subject to further processing as described herein. One of the liquid components separated from the offgas stream 18 in the main column vapor receiver 24 may be taken as an unstabilized gasoline stream 26 that is employed for absorptive separation as described in further detail below. Unstabilized gasoline generally includes hydrocarbons that are present in the overhead vapor stream 22 and that condense at a temperature of less than or equal to about 160° C., and the unstabilized gasoline is generally rich in C4 to C8 hydrocarbons. As referred to herein, "rich" means that the stream at issue includes at least 50 weight % of the referenced compounds. The cracked stream 12 may include any compounds that remain uncondensed after passing through the main column vapor receiver 24 and may include the sulfur-containing component as well as hydrogen, nitrogen, oxygen, carbon monoxide, carbon dioxide, methane, C2 hydrocarbons, and C3 hydrocarbons, as well as significant amounts of C4 and C5 hydrocarbons (e.g., up to about 40 weight % of C4 and C5 hydrocarbons based on the total weight of the cracked stream 12).

The cracked stream 12 is compressed to produce a pressurized cracked stream 28, and the pressurized cracked stream 28 is separated in a pressurized separation stage to produce a pressurized vapor stream 36 that includes C4− hydrocarbons and a liquid hydrocarbon stream 38 that includes C3+ hydrocarbons. In an embodiment and referring again to FIG. 1, a compressor 30 is in fluid communication with the FCC unit 16 to receive the cracked stream 12 and has the capacity to produce the pressurized cracked stream 28. The pressurized cracked stream 28 may be directed through a cooler or heat exchanger 32 to cool the pressurized cracked stream 28. The pressurized cracked stream 28 is then introduced into the pressurized separation stage, which may include a high pressure receiver 34 that is in fluid communication with the compressor 30. The high pressure receiver 34 has the capacity to separate the pressurized cracked stream 28 into the pressurized vapor stream 36 and the liquid hydrocarbon stream 38, although it is to be appreciated that the high pressure receiver 34 may also have the capacity to separate one or more additional liquid streams from the pressurized cracked stream 28 in accordance with conventional techniques. The pressurized vapor stream 36 includes C4− hydrocarbons, and the liquid hydrocarbon stream 38 includes C3+ hydrocarbons. While the exemplary pressurized vapor stream 36 includes C4− hydrocarbons present as a majority of all hydrocarbons present therein, it is to be appreciated that the pressurized vapor stream 36 may include residual hydrocarbons having more than 4 carbon atoms in accordance with known limits on liquid/vapor separation of such hydrocarbons in a conventional high pressure receiver. Likewise, the exemplary liquid hydrocarbon stream 38 includes C3+ hydrocarbons present as a majority of all hydrocarbons present therein, but may include residual hydrocarbons having fewer than 3 carbon atoms. Portions of the sulfur-containing component may be included in both the pressurized vapor stream 36 and the liquid hydrocarbon stream 38.

The liquid hydrocarbon stream 38 is separated to produce a first liquid absorption stream 48 that includes C5+ hydrocarbons and a C4− hydrocarbon stream 50. As referred to herein, the first liquid absorption stream 48 is a stream that is employed for absorptive separation of C4− hydrocarbons from pressurized vapor stream 36, as described in further detail below. As alluded to above, some C3− hydrocarbons may remain in the liquid hydrocarbon stream 38 due to limits of liquid/vapor phase separation in the high pressure receiver 34. It is to be appreciated that intermediate unit operations may be conducted to separate C3− hydrocarbons from the liquid hydrocarbon stream 38 prior to separating the first liquid absorption stream 48 therefrom. For example, C3− hydrocarbons may be fractionated from the liquid hydrocarbon stream 38 to produce a recovered C3− vapor stream 54 and an intermediate C3+ stream 56. In particular, in an embodiment and as shown in FIG. 1, a stripper 52 is in fluid communication with the high pressure receiver 34, and the stripper 52 has the capacity to separate the liquid hydrocarbon stream 38 into the recovered C3− vapor stream 54 and the intermediate C3+ stream 56. The recovered C3− vapor stream 54 may be recycled to the pressurized separation stage, e.g., the recovered C3− vapor stream 54 may be combined with the pressurized cracked stream 28 for subsequent separation. In the exemplary embodiment, a debutanizer column 58 is in fluid communication with the high pressure receiver 34, with the stripper 52 disposed in fluid communication between the high pressure receiver 34 and the debutanizer column 58 upstream of the debutanizer column 58. The debutanizer column 58 has the capacity to produce the first liquid absorption stream 48 that includes C5+ hydrocarbons and the C4− hydrocarbon stream 50 through conventional fractionation techniques, e.g., by fractionating the intermediate C3+ stream 56 to produce the first liquid absorption stream 48 and the C4− hydrocarbon stream 50. In this embodiment, due to the presence of the stripper 52 that removes much of the C3− hydrocarbons, the debutanizer column 58 generally removes any remaining C3− compounds in the C4− hydrocarbon stream 50 such that the first liquid absorption stream 48 is substantially free of hydrocarbons that have fewer than 4 carbon atoms. By "substantially free", it is meant that the first liquid absorption stream 48 includes less than about 10 weight %, such as less than about 5 weight %, such as less than about 2 weight % of hydrocarbons that have fewer than 4 carbon atoms based on the total weight of the first liquid absorption stream 48, which enables excessive buildup of C4− hydrocarbons during processing to be avoided.

In accordance with an embodiment, the sulfur-containing component is removed from the pressurized vapor stream 36 to produce a sulfur-containing waste stream 44 and a purified pressurized vapor stream 46. In this embodiment, at least some of the sulfur-containing component is separated with the pressurized vapor stream 36 during separation of the pressurized cracked stream 28 into the pressurized vapor stream 36 and the liquid hydrocarbon stream 38. It is to be appreciated that, in accordance with the methods described herein, at least a portion of the sulfur-containing component is removed; the entire sulfur-containing component need not be separated so long as at least some of the sulfur-containing component is separated. However, in embodiments, at least about 95 weight % of the sulfur-containing component is removed, such as at least about 99 weight %, based upon an original amount of the sulfur-containing component in the stream from which the sulfur-containing component is removed. In an embodiment and as shown in FIG. 1, a contaminant removal unit 40 is disposed in fluid communication with the high pressure receiver 34, downstream of the FCC unit 16, and the contaminant removal unit 40 is configured to remove the sulfur-containing component from the pressurized vapor stream 36 to produce the purified pressurized vapor stream 46. In embodiments, the contaminant removal unit 40 may operate through a chemical solvent separation technique. For example, in an embodiment, the contaminant removal unit 40 removes the sulfur-containing component through an amine absorption technique by which the pressurized vapor stream 36 is contacted with an aqueous amine solution 42 in the contaminant removal unit 40. Many different amines can be used in the aqueous amine solution 42 such as, but not limited to, monoethanol amine, diethanol amine, methyl diethanol amine, triethanol amine, 2-amino-2-methyl-1-propanol, diglycol amine, diisopropanol amine, piperazine, other amines, or combinations thereof. Contaminant removal units that employ aqueous amine solutions are known in the art. For example, the contaminant removal unit 40 may include a fluidized bed (not shown), and the pressurized vapor stream 36 may be contacted with the aqueous amine solution 42 in the fluidized bed of the contaminant removal unit 40 to produce the purified pressurized vapor stream 46. In some embodiments, the amine is present in the aqueous amine solution 42 at a concentration of from about 20 to about 40 weight % and water is present at a concentration of from about 50 to about 80 weight %, both based on the total weight of the aqueous amine solution 42. In other embodiments and although not shown, it is to be appreciated that other types of separation units may be employed as the contaminant removal unit, such as a membrane separation unit that operates through a membrane separation technique.

In accordance with the exemplary method, C3+ hydrocarbons are absorbed from the pressurized vapor stream 36 through liquid-vapor phase absorption using a liquid absorption stream. In an embodiment and as shown in FIG. 1, the first liquid absorption stream 48 is employed for absorption of the C3+ hydrocarbons from the purified pressurized vapor stream 46. For example, as shown in FIG. 1, a liquid-vapor phase separator 60, also commonly referred to as a primary absorber, is in fluid communication with the debutanizer column 58 for receiving the first liquid absorption stream 48 therefrom, and the liquid-vapor phase separator 60 is further in fluid communication with the contaminant removal unit 40 for receiving the purified pressurized vapor stream 46 therefrom. The liquid-vapor phase separator 60 is configured to contact the purified pressurized vapor stream 46 and the first liquid absorption stream 48 therein through conventional liquid-vapor phase absorption techniques. The net effect of this contacting is a separation between C3+ and C2− fractions, and separation efficiency is maximized due to the upstream removal of the sulfur-containing component. It is to be appreciated that one or more other liquid absorption streams may be employed to absorb the C3+ hydrocarbons from the purified pressurized vapor stream 46, and the other liquid absorption streams may be employed in addition or as an alternative to the first liquid absorption stream 48. For example, the unstabilized gasoline stream 26 from the main column vapor receiver 24 may be employed as a second liquid absorption stream 26 for absorption of the C3+ hydrocarbons from the purified pressurized vapor stream 46. In the exemplary embodiment, the unstabilized gasoline stream 26 is fed from the main column vapor receiver 24 to the liquid-vapor phase separator 60. The unstabilized gasoline stream 26 and the first liquid absorption stream 48 are both effective absorbing streams for absorptively separating the C3+ hydrocarbons from the purified pressurized vapor stream 46 due to the types of hydrocarbons included therein, with the unstabilized gasoline stream 26 including mostly C4 to C8 hydrocarbons and the first liquid absorption stream 48 including mostly C5 to C8 hydrocarbons. Although not shown, one or more sidedraws may be withdrawn from the liquid-vapor phase separator 60, cooled, and reintroduced for purposes of maintaining substantially uniform temperature within the liquid-vapor phase separator 60. A C3+ rich stream 65 that includes the absorbed C3+ hydrocarbons from the purified pressurized vapor stream 46 as well as components from the first liquid absorption stream 48 and/or the second liquid absorption stream 26 is generally returned to the high pressure receiver 34 for further separation.

Absorbing the C3+ hydrocarbons from the purified pressurized vapor stream 46 generally produces a residual vapor stream 62 that includes residual C3− hydrocarbons, and possibly small amounts of C4 hydrocarbons, due to separation limits during conventional operation of liquid-vapor phase absorption. In embodiments, most of the residual C3 and C4 hydrocarbons are absorbed from the residual vapor stream 62 using a third liquid absorption stream 64 that is different from the first liquid absorption stream 48. For example, a light cycle oil stream 64 may be employed as the third liquid absorption stream 64, and the light cycle oil stream 64 may be produced as a fraction taken from the offgas stream 18 by the FCC main column 20. In an embodiment and as shown in FIG. 1, a secondary absorber 66, also referred to as a sponge absorber, may be in fluid communication with the liquid-vapor phase separator 60 for receiving the residual vapor stream 62 and contacting the residual vapor stream 62 with the third liquid absorption stream 64. As a result of absorptive separation of the residual vapor stream 62, a secondary C3+ rich stream 68 that includes the residual C3 and C4 hydrocarbons from the residual vapor stream 62 as well as components from the third liquid absorption stream 64 are returned to the FCC main column 20 for further separation.

Figure 2:
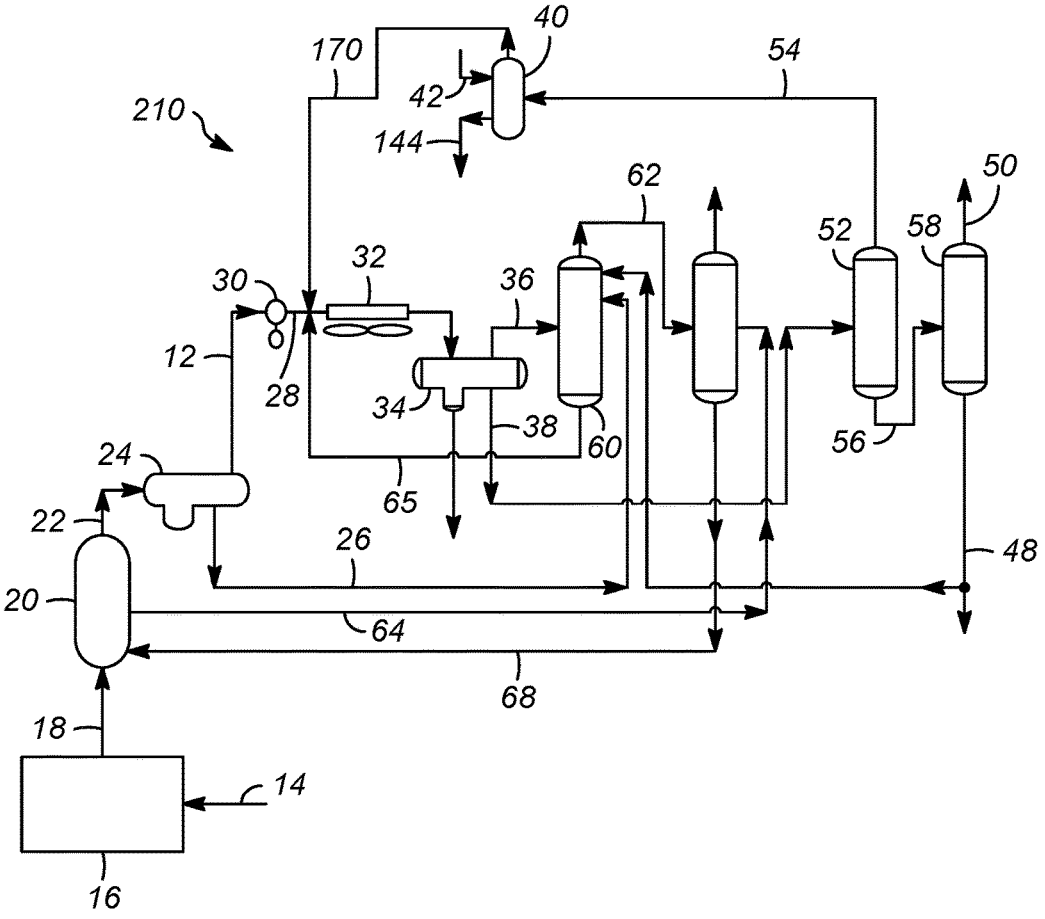
FIG. 2 is a schematic diagram of a hydrocarbon processing apparatus and method of refining hydrocarbons in accordance with another exemplary embodiment.

Another embodiment of a method of refining hydrocarbons will now be described with reference to an exemplary hydrocarbon processing apparatus 210 as shown in FIG. 2. The method and apparatus 210 of this embodiment is similar to the embodiment described above with reference to FIG. 1, but the sulfur-containing component is removed from a different stream than in the embodiment of FIG. 1. As alluded to above, portions of the sulfur-containing component are generally included in both the pressurized vapor stream 36 and in the liquid hydrocarbon stream 38. In the embodiment, at least some of the sulfur-containing component is separated with the liquid hydrocarbon stream 38 during separation of the pressurized cracked stream 28 into the pressurized vapor stream 36 and the liquid hydrocarbon stream 38. Whereas the method and apparatus 10 described above with reference to FIG. 1 involves removal of the sulfur-containing component from the pressurized vapor stream 36, in the embodiment of FIG. 2, the sulfur-containing component is separated from the liquid hydrocarbon stream 38. In particular, the liquid hydrocarbon stream 38 is separated into the recovered C3− vapor stream 54 and the intermediate C3+ stream 56 in the stripper 52 in the same manner as described above, and most of the sulfur-containing component that is present in the liquid hydrocarbon stream 38 is separated with the recovered C3− vapor stream 54 due to the separation conditions. The sulfur-containing component is separated from the recovered C3− vapor stream 54 to produce a sulfur-containing waste stream 144 and a purified C3− vapor stream 170. The purified C3− vapor stream 170 may then be recycled to the pressurized separation stage, such as by combining the purified C3− vapor stream 170 and the pressurized cracked stream 28, for further separation. Separation of the sulfur-containing component from the recovered C3− vapor stream 54 lowers the overall content of the sulfur-containing component in the streams processed by the apparatus 210, even though removal of the sulfur-containing component in this embodiment does not occur directly prior to absorptive separation in the liquid-vapor phase separator 60. Further, separation of the sulfur-containing component in this embodiment minimizes loss of desirable hydrocarbons to the sulfur-containing waste stream 144 since most desirable hydrocarbons are separated upstream of the contaminant removal unit 40. It is to be appreciated that, although not shown, the sulfur-containing component may be removed from both the pressurized vapor stream 36 and the liquid hydrocarbon stream 38 through separate unit operations or the same unit operation.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration in any way. Rather, the foregoing detailed description will provide those skilled in the art with a convenient road map for implementing an exemplary embodiment. It being understood that various changes may be made in the function and arrangement of elements described in an exemplary embodiment without departing from the scope as set forth in the appended claims.

What is claimed is:

1. A method of refining hydrocarbons, wherein the method comprises:

providing a cracked stream comprising a sulfur-containing component and cracked hydrocarbons;

compressing the cracked stream to produce a pressurized cracked stream;

separating the pressurized cracked stream to produce a pressurized vapor stream comprising C4− hydrocarbons and a liquid hydrocarbon stream comprising C3+ hydrocarbons;

separating the liquid hydrocarbon stream to produce a first liquid absorption stream comprising C5+ hydrocarbons and a C4− hydrocarbon stream;

absorbing C3+ hydrocarbons from the pressurized vapor stream through liquid-vapor phase absorption using the first liquid absorption stream to produce a residual vapor stream comprising residual C3− hydrocarbons;

absorbing the residual C3− hydrocarbons from the residual vapor stream using a liquid absorption stream different from the first liquid absorption stream; and removing the sulfur-containing component prior to absorbing C3+ hydrocarbons from the pressurized vapor stream.

2. The method of claim 1, wherein separating the liquid hydrocarbon stream comprises separating the liquid hydrocarbon stream to produce the first liquid absorption stream substantially free of hydrocarbons having fewer than 5 carbon atoms.

3. The method of claim 1, wherein removing the sulfur-containing component comprises separating the sulfur-containing component with the liquid hydrocarbon stream during separation of the pressurized cracked stream into the pressurized vapor stream and the liquid hydrocarbon stream.

4. The method of claim 3, wherein separating the liquid hydrocarbon stream comprises fractionating C3− hydrocarbons and the sulfur-containing component from the liquid hydrocarbon stream to produce a recovered C3− vapor stream comprising the sulfur-containing component and an intermediate C3+ stream.

5. The method of claim 4, wherein removing the sulfur-containing component further comprises separating the sulfur-containing component from the recovered C3− vapor stream to produce a sulfur-containing waste stream and a purified C3− vapor stream.

6. The method of claim 5, further comprising combining the purified C3− vapor stream with the cracked stream.

7. The method of claim 1, wherein removing the sulfur-containing component comprises separating the sulfur-containing component with the pressurized vapor stream during separation of the pressurized cracked stream into the pressurized vapor stream and the liquid hydrocarbon stream.

8. The method of claim 7, wherein removing the sulfur-containing component further comprises separating the sulfur-containing component from the pressurized vapor stream to produce a sulfur-containing waste stream and a purified pressurized vapor stream.

9. The method of claim 1, and wherein separating the liquid hydrocarbon stream comprises fractionating C3− hydrocarbons from the liquid hydrocarbon stream to produce a recovered C3− vapor stream and an intermediate C3+ stream.

10. The method of claim 9, wherein separating the liquid hydrocarbon stream further comprises fractionating the intermediate C3+ stream to produce the first liquid absorption stream and the C4− hydrocarbon stream.

11. The method of claim 1, wherein absorbing the C3+ hydrocarbons further comprises absorbing the C3+ hydrocarbons using a second liquid absorption stream comprising unstabilized gasoline.

12. The method of claim 1, wherein providing the cracked stream comprises providing an overhead vapor stream from a main column vapor receiver.

13. The method of claim 1, wherein absorbing the C3+ hydrocarbons from the pressurized vapor stream produces a residual vapor stream comprising residual C3− hydrocarbons.

14. The method of claim 13, further comprising absorbing the residual C3− hydrocarbons from the residual vapor stream using a third liquid absorption stream different from the first liquid absorption stream.

15. The method of claim 1, wherein removing the sulfur-containing component comprises removing the sulfur-containing component through one or more of an amine absorption technique or a membrane separation technique.

16. A method of refining hydrocarbons, wherein the method comprises:

cracking a hydrocarbon stream comprising a sulfur-containing component in a fluid catalytic cracking stage to produce a cracked stream comprising the sulfur-containing component and cracked hydrocarbons;

compressing the cracked stream to produce a pressurized cracked stream;

separating the pressurized cracked stream in a pressurized separation stage to produce a pressurized vapor stream comprising C4− hydrocarbons and a liquid hydrocarbon stream comprising C3+ hydrocarbons and the sulfur-containing component;

fractionating the liquid hydrocarbon stream to produce an intermediate C3+ stream comprising C3+ hydrocarbons and a recovered C3− vapor stream comprising C3− hydrocarbons and the sulfur-containing component;

removing the sulfur-containing component from the recovered C3− vapor stream to produce a purified C3− vapor stream;

recycling the purified C3− vapor stream to the pressurized separation stage; and absorbing C3+ hydrocarbons from the pressurized vapor stream through liquid-vapor phase absorption using a liquid absorption stream to produce a residual vapor stream comprising residual C3− hydrocarbons;

absorbing the residual C3− hydrocarbons from the residual vapor stream using a liquid absorption stream different from the first liquid absorption stream.

17. A hydrocarbon processing apparatus comprising:

a fluid catalytic cracking unit having the capacity to catalytically crack a hydrocarbon stream comprising a sulfur-containing component and to produce an offgas stream comprising the sulfur-containing component and cracked hydrocarbons;

a compressor in fluid communication with the fluid catalytic cracking unit and having the capacity to produce a pressurized cracked stream;

a high pressure receiver in fluid communication with the compressor and having the capacity to separate the pressurized cracked stream into a pressurized vapor stream and a liquid hydrocarbon stream;

a debutanizer column in fluid communication with the high pressure receiver and having the capacity to produce a first liquid absorption stream;

a liquid-vapor phase separator in fluid communication with the debutanizer column, wherein the liquid-vapor phase separator is configured to contact the pressurized vapor stream and the first liquid absorption stream therein; and a contaminant removal unit disposed upstream of the liquid-vapor phase separator and downstream of the fluid catalytic cracking unit and an overhead line of said high pressure receiver or a stripper, wherein the contaminant removal unit is configured to remove the sulfur-containing component.

18. The hydrocarbon processing apparatus of claim 17, further comprising a stripper in fluid communication with the high pressure receiver and having the capacity to separate the liquid hydrocarbon stream into a recovered C3− vapor stream and an intermediate C3+ stream, wherein the stripper is further in fluid communication with the debutanizer column and upstream thereof.

19. The hydrocarbon processing apparatus of claim 18, wherein the contaminant removal unit is in fluid communication with the stripper for receiving the recovered C3− vapor stream and removing the sulfur-containing component therefrom.

20. The hydrocarbon processing apparatus of claim 17, wherein the contaminant removal unit is in fluid communication with the high pressure receiver for receiving the pressurized vapor stream and removing the sulfur-containing component therefrom.

* * * * *